US008402934B2

(12) United States Patent
Bender

(10) Patent No.: US 8,402,934 B2
(45) Date of Patent: Mar. 26, 2013

(54) ELECTROMAGNETIC CAMSHAFT ADJUSTMENT DEVICE

(75) Inventor: Stefan Bender, Engen (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 13/262,243

(22) PCT Filed: Mar. 24, 2010

(86) PCT No.: PCT/EP2010/001833

§ 371 (c)(1),
(2), (4) Date: Sep. 30, 2011

(87) PCT Pub. No.: WO2010/112162

PCT Pub. Date: Oct. 7, 2010

(65) Prior Publication Data

US 2012/0031362 A1 Feb. 9, 2012

(30) Foreign Application Priority Data

Apr. 3, 2009 (DE) ..... 20 2009 004 611 U

(51) Int. Cl.
*F01L 1/34* (2006.01)

(52) U.S. Cl. ..... 123/90.17; 123/90.15; 123/90.11

(58) Field of Classification Search ..... 123/90.15, 123/90.17, 90.11, 90.31
See application file for complete search history.

(56) References Cited

U.S. PATENT DOCUMENTS

| | | | | |
|---|---|---|---|---|
| 4,756,331 | A | 7/1988 | Stegmaier | |
| 6,273,122 | B1 * | 8/2001 | Schudt et al. | 137/315.03 |
| 6,571,757 | B1 | 6/2003 | Simpson | |
| 2003/0087536 | A1 | 5/2003 | Ito et al. | |
| 2004/0041114 | A1 | 3/2004 | Hirata et al. | |
| 2011/0210277 | A1 | 9/2011 | Bender | |

FOREIGN PATENT DOCUMENTS

| | | | |
|---|---|---|---|
| DE | 4239986 | A1 | 6/1993 |
| DE | 202008013654 | U1 | 3/2010 |
| EP | 0203453 | A2 | 12/1986 |
| GB | 956668 | A | 4/1964 |
| GB | 2261931 | A | 6/1993 |

* cited by examiner

*Primary Examiner* — Zelalem Eshete
(74) *Attorney, Agent, or Firm* — Bachman & LaPointe, P.C.

(57) ABSTRACT

An electromagnetic camshaft adjusting device has an armature unit, which can be moved relative to a yoke and core unit by energizing a stationary coil unit and which is designed to carry out an axial actuating movement and to exert a correspondingly axially directed actuating force on a rotating internal combustion engine camshaft by a slider unit interacting with the armature unit. The yoke and core unit is mounted such that it can rotate relative to the coil unit and provides a receptacle for the armature unit that is guided such that it can move axially in the yoke and core unit and has the slider unit firmly seated thereon.

10 Claims, 2 Drawing Sheets

ELECTROMAGNETIC CAMSHAFT ADJUSTMENT DEVICE

BACKGROUND

The present invention relates to an electromagnetic camshaft adjustment device in accordance with the preamble of the main claim.

DE 20 2008 013 654 of the applicant discloses such a device and describes a device which is provided at an end face of a camshaft of an internal combustion engine, which device is in the axial position with respect to this engine camshaft and effects an axial movement of the camshaft adjustment system (more precisely: of a slide valve) as a reaction to a supply of the stationary coil unit with electricity and by means of the movement of the armature unit effected thereby.

SUMMARY OF THE INVENTION

The advantage of this device known from the prior art is the possibility produced by the running or bearing ball on the tappet end of the armature tappet of being able to absorb any camshaft movements in a low-wear manner, so such a mechanical procedure has proven effective in practice.

This assumed starting situation for the present invention is illustrated using FIG. 3: An armature unit formed from an axial armature tappet 10 and a cup-shaped armature section 12 is guided in a movable manner in the axial direction with respect to a stationary coil unit 14 (winding on a coil support); to form the magnetic circuit, a yoke/core unit consisting of a yoke section 16 and a core section 18 situated in one piece thereon is formed between the movable armature unit and the stationary coil unit 14, wherein the unit 16, 18 is formed in one piece with a transition section 20 which tapers in a double-cone-like manner; the purpose of the said transition section is to form both units 16, 18 in one piece and thus in a centred manner to each other and to effect rapid saturation of the magnetic flux (by means of the reduced thickness) and thus largely to isolate the two elements 16, 18 magnetically from each other.

In the manner shown in DE 20 2008 013 654, a ball 24 is mounted in a rollable manner in a recess 22 on the contact side of the armature, which recess can absorb transverse movements and/or an axial offset of the interacting camshaft unit 26 in the manner shown; the latter, consisting of a slide valve (slide valve unit) 28 which can be adjusted in the axial direction (i.e. downwards in the figure) by the armature unit, a valve housing 30 which radially surrounds the said slide valve and a camshaft 32 (rotating at the camshaft speed), is connected to the ball 24 and thus to the armature unit by means of a cap 34 pressed in at the end. The yoke/core unit 16, 18, the coil unit 14 and the surrounding housing 36 are provided in a stationary manner on the engine block; the armature unit 10 is mounted such that it can only be displaced in the axial direction, wherein the ball 24 absorbs a rotary movement of the camshaft unit.

While such a device is advantageous in particular with respect to movement and manufacturing tolerances, the long (axial) installation length of this unit often has a negative effect, however; added to this is the design effort associated with the installation and the configuration of the (separate) bearing between the electromagnetic actuation device and the camshaft unit.

There is therefore a need in particular in connection with restricted space conditions in the installation space to reduce the axial length (installation length) of a generic device in order to meet further restricted installation conditions.

The object of the present invention is therefore to reduce the axial installation length of an electromagnetic camshaft adjustment device according to the preamble of the main claim and at the same time to reduce the design and installation effort.

The object is achieved by the electromagnetic camshaft adjustment device having the features of the main claim; advantageous developments of the invention are described in the subclaims.

Advantageously according to the invention, the yoke and core unit (also yoke/core unit) is first mounted such that it can rotate relative to the coil unit (i.e. can rotate about the axial direction), wherein the armature unit with the slide unit situated in a fixed manner thereon is guided therein. This advantageously makes it possible for the armature unit including the surrounding yoke/core unit to rotate with the camshaft, while the yoke/core unit is supported externally on the lateral surface side by a radial bearing.

The axial installation length can thus advantageously be minimised, as it is then possible according to the invention to integrate the slide valve unit (slide unit) directly in or on the armature unit and in this respect produce a fixed connection between the armature unit and the actuation element of the camshaft adjustment system. The bearing formed approximately in the form of the combination of cap (reference symbol 34 in FIG. 3) and ball (24) becomes superfluous.

Furthermore, it is advantageously possible according to the invention for the yoke and core unit to be supported on the lateral surface side of a housing section (present in any case), preferably on an inner wall region of the housing (second stationary housing wall section) which surrounds the stationary coil unit.

If the yoke and core unit is then formed in one piece, as also provided according to a development, advantageously reinforced in the transition region with a non-magnetic material to be applied (welded on) according to a further development, and then this transition region material is then also used to support the unit against a further (first) housing section in the form of an axial bearing, a device is created which can withstand high loads, can be produced very simply and has minimal production and installation effort.

It is then possible within the context of preferred embodiments of the invention to configure the radial bearing between the yoke and core unit on the one hand and the stationary housing wall on the other in the form of a sliding bearing, which is suitably coated with a non-magnetic material (in order to prevent a magnetic circuit), for example by deposition welding, so the effort can also be minimised here. On the other hand, as part of an additional or alternative embodiment of the invention, this radial bearing can be implemented by a bearing bushing or similar additional mechanical element, which is also suitably and advantageously realised in a non-magnetic material.

As part of further developments of the invention, the slide unit (slide valve) is realised in non-magnetic material such that it is situated fixedly on the armature unit (for example by a suitable interference fit) and therefore does not affect the functioning of the actual electromagnetic actuation section in the interaction between the armature and the yoke core. As a result a way has been created with the present invention to combine the issues of compact installation space with the greatest possible reliability, and simple production and installation while clearly reducing the outlay on components and at the same time creating the possibility of minimising the axial extent (in particular from the end face of the camshaft arrangement).

BRIEF DESCRIPTION OF THE DRAWINGS

Further advantages, features and details of the invention can be found in the following description of preferred exemplary embodiments, using the drawings. In the figures.

DETAILED DESCRIPTION OF THE PREFERRED EMBODIMENT(S)

Figure 1:
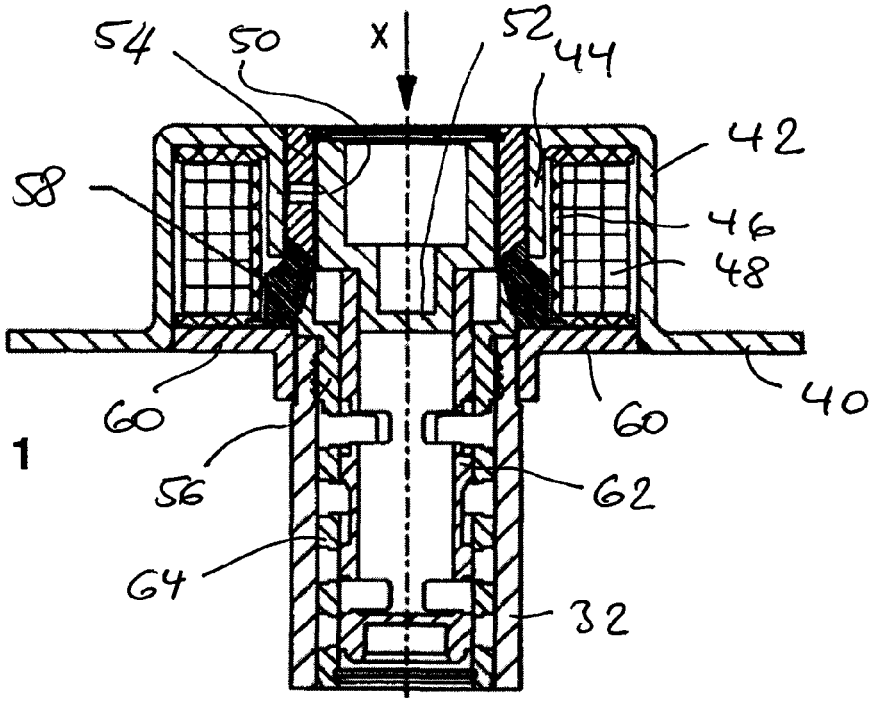
FIG. 1 shows a schematic longitudinal sectional view through the electromagnetic camshaft adjustment device according to a first, preferred embodiment of the invention.

The exemplary embodiment of FIG. 1 illustrates a housing 42 which revolves in an annular manner with an outer ring flange 40 and forms an inner, hollow cylindrical housing wall 44 which extends for a predefined section along the axial direction x. A coil 48 is provided in an otherwise known manner on a coil support unit 46 in the interior of the annular housing section, which coil can be supplied with electricity in an otherwise known manner in order to move the armature unit 50 in the axial direction.

The armature unit, which in the exemplary embodiment described is cup-shaped with a contact section 52 which has a tapered diameter, is guided axially in a yoke and core unit in an otherwise known manner, for example, by interposing an armature guide tube (not shown) or a magnetically non-conductive coating (not shown), which yoke and core unit consists of an upper yoke unit 54 and a lower core unit 56. Both units 54, 56 are tapered in a double-cone-like manner in the direction of an axial transition section (cf. FIG. 3), wherein a mechanical reinforcement in the form of a welded-on portion consisting of non-magnetic material 58 (more precisely: CuZn) is provided in the exemplary embodiment shown.

As illustrated in FIG. 1, this material has been applied and then post-processed by lathe machining in order to fit into the free space formed by the lower open housing wall and the coil body 56 in the radial direction and at the same time to form a sliding bearing (as an axial bearing) in contact with a lower, disc-shaped housing lid 60: According to the invention, the unit consisting of armature 50, 52, slide valve unit (slide unit) 62 situated thereon, yoke and core unit 54, 56, 58, is actually guided rotatably inside the vertical wall 44 of the housing which revolves in a hollow cylindrical manner, so the unit can revolve with the rotation of the camshaft 32; it would then be possible for a forward movement of the armature unit 50, 52 with the slide unit 56 situated axially fixedly thereon (by an interference fit) to take place when the coil unit 46, 48 is supplied with electricity, in order to effect the desired camshaft adjustment function.

Figure 3:
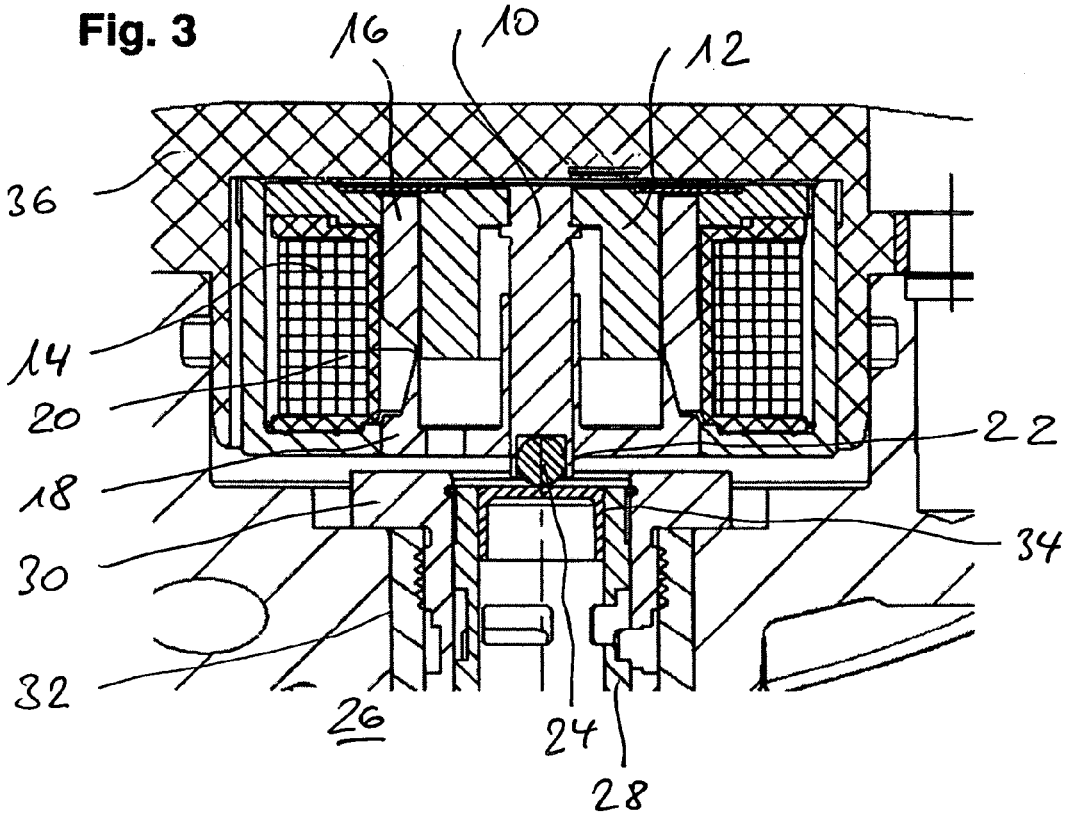
FIG. 3 shows a diagram of a device for illustrating the technology used for the preamble.

As FIG. 1 also shows, the core unit 56 merges in one piece into a valve housing section 64, which corresponds in this respect to the unit 30 of FIG. 3 and can rotate due to its fixed connection to the yoke unit 54 (by means of the applied non-magnetic material 58 on the transition region). The armature movement in the axial direction (x) then effects an axial relative displacement between the units 62 and 56/64 in an otherwise known manner.

It is clear that the device realised according to FIG. 1 has considerable design advantages: Not only is the axial extent starting from the end of the camshaft unit drastically reduced by integration with the armature unit, cf. FIG. 3 and FIG. 1 together, but also the number of structural elements required is reduced, which is advantageous in particular for cost-sensitive large-scale line production.

Figure 2:
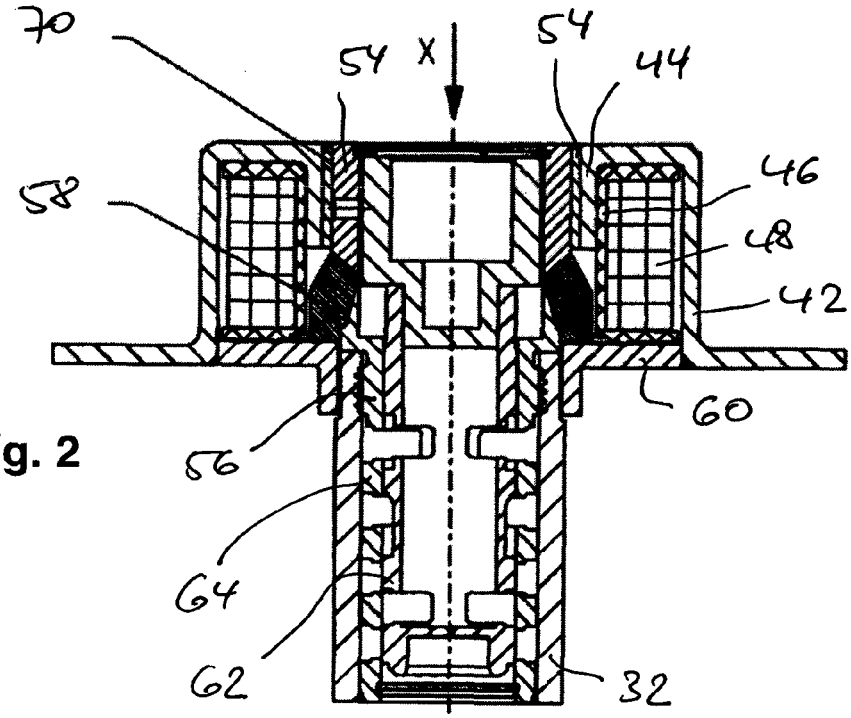
FIG. 2 shows a diagram analogous to FIG. 1 of a second embodiment but with a radial bearing realised by means of a separate bearing bushing.

FIG. 2 shows a variant of the embodiment according to FIG. 1 (with otherwise the same reference symbols and correspondingly the same functional components). Instead of the sliding bearing realised by the magnetically non-conductive layer applied by deposition welding or in a similar manner and formed in the transition region between the yoke and core unit 50 to 58 and the inner wall 44, this function is replaced by a bearing bushing 70 which is formed in the said transition region between the wall section 44 of the housing and the yoke section 54 of the yoke and core section, in order to make the radial bearing function possible. Although an additional structural element is required in this procedure, the total outlay can still be reduced depending on the production and installation method.

The invention claimed is:

1. Electromagnetic camshaft adjustment device comprising:

an armature unit, which can be moved relative to a yoke and core unit by supplying a stationary coil unit with electricity and which is formed to execute an axial actuation movement and to exert a correspondingly axially directed actuation force on a rotating camshaft of an internal combustion engine by means of a slide unit which interacts with the armature unit, and the yoke and core unit being mounted to rotate relative to the coil unit and providing a receptacle for the armature unit with the slide unit situated fixedly thereon, which is guided in an axially movable manner in the yoke and core unit.

2. Device according to claim 1, the yoke and core unit is realized in a rotationally symmetrical manner from yoke and core sections which are connected fixedly to each other by means of a transition section, and wherein the transition section has reduced magnetic flux conductivity compared to the yoke and core sections.

3. Device according to claim 2, wherein the transition section comprises a non-magnetically conductive connecting material.

4. Device according to claim 2, wherein the transition section is soldered or welded onto the yoke and core section.

5. Device according to claim 2, wherein the transition section forms an axial bearing, against a first stationary housing section which is adjacent to the coil unit.

6. Device according to claim 1, wherein the yoke and core unit is mounted by a radial sliding bearing which effects a magnetic isolation from a second stationary housing section which is adjacent to the coil unit and extends axially.

7. Device according to claim 6, wherein a bearing bushing consisting of non-magnetically conductive material is provided between the yoke and core unit and the second housing section to realize the radial sliding bearing.

8. Device according to claim 6, wherein an isolating layer consisting of non-magnetically conductive material is provided between the yoke and core unit and the second housing section, and said isolating layer is realized by deposition welding on a lateral surface side onto a section of the yoke and core unit.

9. Device according to claim 1, wherein the slide unit is axially extending and cylindrical slide unit is realized in non-magnetic material.

10. Device according to claim 1, wherein the slide unit is fastened axially to the armature unit, and is situated on the armature unit by means of a press fit or an interference fit.

* * * * *